US010600343B1

(12) United States Patent
Javaheri et al.

(10) Patent No.: US 10,600,343 B1
(45) Date of Patent: Mar. 24, 2020

(54) MULTI-FUNCTIONAL SIDEWALK SIGN ADJACENT A CORNER OF INTERSECTING TRAFFIC TO PROVIDE VISIBLE ADVERTISING TO ONCOMING TRAFFIC AND CONCEAL A TRAFFIC CONTROL SIGNAL BOX

(71) Applicants: Alexander Javaheri, Los Angeles, CA (US); Manoucher Issari, West Hollywood, CA (US)

(72) Inventors: Alexander Javaheri, Los Angeles, CA (US); Manoucher Issari, West Hollywood, CA (US)

( * ) Notice: Subject to any disclaimer, the term of this patent is extended or adjusted under 35 U.S.C. 154(b) by 0 days.

(21) Appl. No.: 16/571,955

(22) Filed: Sep. 16, 2019

(51) Int. Cl.
*G09F 15/00* (2006.01)
*G09F 15/02* (2006.01)

(52) U.S. Cl.
CPC ..... *G09F 15/0037* (2013.01); *G09F 15/0018* (2013.01); *G09F 15/02* (2013.01)

(58) Field of Classification Search
CPC ... G09F 15/0037; G09F 15/0018; G09F 15/02
See application file for complete search history.

(56) References Cited

U.S. PATENT DOCUMENTS 5,208,585 A * 5/1993 Sprague ..... E01F 15/086 116/63 T
8,732,999 B1 * 5/2014 Hughes ..... G09F 15/0018 160/329
2001/0035701 A1 * 11/2001 Holzheid ..... G09F 15/0012 312/204
2015/0047240 A1 * 2/2015 Pyc ..... G09F 15/0006 40/611.01
2016/0111031 A1 * 4/2016 Cikanek ..... G09F 15/0062 434/414

* cited by examiner

*Primary Examiner* — Gary C Hoge
(74) *Attorney, Agent, or Firm* — Thomas I. Rozsa

(57) ABSTRACT

A multi-functional advertising sidewalk sign which is affixed into a sidewalk to prevent the sidewalk sign from being moved or stolen. The invention is a large display sign with two large rotatably connected panels, each of which retains a large poster which is visible from one to fifty feet away. The sign is positioned and affixed into a sidewalk adjacent a corner of intersecting traffic so that information on each retained poster is visible to oncoming traffic as a vehicle approaches the intersection traveling in a direction where the poster is visible to oncoming traffic.

7 Claims, 5 Drawing Sheets

MULTI-FUNCTIONAL SIDEWALK SIGN ADJACENT A CORNER OF INTERSECTING TRAFFIC TO PROVIDE VISIBLE ADVERTISING TO ONCOMING TRAFFIC AND CONCEAL A TRAFFIC CONTROL SIGNAL BOX

BACKGROUND OF THE INVENTION

1. Field of the Invention

The present invention relates to the field of display signs which are large physical structures that are positioned on a sidewalk or at a safe location within a street to provide an advertising display to be viewed by oncoming traffic.

2. Description of the Prior Art

In general, street signs which are placed on sidewalks are known in the prior art. Traffic signals at street corners are controlled by a traffic control signal box which is a locked physical structure which retains the traffic control signal equipment therein. The traffic control signal box is an unprotected structure and unfortunately, provides a surface for gangs to spray paint or otherwise deface the surfaces of the traffic control signal box.

There is a significant need to provide a source of protection to block access to the visible surfaces of the traffic control signal box to reduce the incidence of defacing the traffic control signal box.

SUMMARY OF THE INVENTION

The present invention is a multi-functional advertising sidewalk sign which is affixed into a sidewalk to prevent the sidewalk sign from being moved or stolen. The present invention is a large display sign with two large rotatably connected panels, each of which retains a large poster which is visible from one to fifty feet away.

The present invention is positioned and affixed into a sidewalk adjacent a corner of intersecting traffic so that information on each retained poster is visible to oncoming traffic as a vehicle approaches the intersection traveling in a direction where the poster is visible to oncoming traffic.

The present invention is also positioned so that it blocks access to the street visible portion of the traffic control signal box to protect it from vandals, gangs and others who might deface the sidewalk visible surfaces of the traffic control signal box.

The present invention multi-functional display retaining sign includes several novel features including: (a) an ability to completely rotate one of the large panels away from blocking access to the traffic control signal box so that an authorized technician will have access to the traffic control signal box to provide standard maintenance and to repair a portion of the equipment if the traffic signal is not working or is working with signal problems; (b) an ability to rotate a panel to a location where the poster retained in the panel is removed and replaced with a different poster and to facilitate cleaning of the inside of the display portion.

It is therefore an object of the present invention to provide a large multi-functional display structure which includes a center support post and a first side support post and a second side support post, each respective side support post being at a spaced apart distance from the center support post to provide supports for each respective display panel.

It is a further object of the present invention to provide a large multi-functional display structure in which each post has a foot section which is affixed into a concrete sidewalk to prevent each post from being moved. Each post leg has a base which is affixed into a sidewalk concrete surface by a one-way screw threaded into the concrete or by an anchor bolt cemented into the concrete.

It is a further object of the present invention to provide a large multi-functional display structure in which each post has a post leg which is sufficiently tall to provide a space between a bottom of a display panel and the concrete ground surface. A distance of at least one foot to three feet, and preferably two feet (twenty-four inches), is provided by the present invention for a distance between a bottom of a display panel and the concrete ground surface.

Most traffic control signal boxes are located on a sidewalk. It is a further object of the present invention to provide a large multi-functional display structure in which each post has a post leg which is sufficiently tall to provide a space between a bottom of a display panel and the concrete ground surface.

It is an object of the present invention to account for the location and widthwise size and lengthwise size of a traffic control signal box. As a general description, a traffic control signal box is twenty-four inches wide, thirty-three inches long and forty-eight inches tall. The traffic control signal box is positioned with a widthwise side parallel to one street and a lengthwise side parallel to an intersecting street at an intersection. The distance from the traffic control signal box to a street is at least seven inches for the curb and at least twenty-eight inches for the sidewalk distance for a total of at least thirty-five inches. The walking distance between an opposite widthwise side of the traffic control signal box and a storefront is at least sixty-two inches for pedestrian foot traffic.

A distance of at least one foot to three feet, and preferably two feet (twenty-four inches), is provided by the present invention for a distance between a bottom of a display panel and the concrete ground surface.

It is an additional object of the present invention to position the center post at a location at an approximate lengthwise center of a traffic control signal box and at a distance from the traffic control signal box so that a rear surface of a first panel is adjacent a first corner at an intersection of a lengthwise side and a first widthwise side of the traffic control signal box and a rear surface of a second panel is adjacent a second corner at an intersection of the same lengthwise side and the second widthwise side of the traffic control signal box.

It is another object of the present invention to provide a display sign retaining a poster in a panel in which each panel includes a non-transparent back such as a metal rear frame panel and a transparent front panel with a display poster affixed to the rear metal panel. The front panel is preferably made of non-breakable transparent material which, by way of example, is fiberglass.

The first front panel is hingeably and rotatably connected to a portion of the rear and retained in a locked condition with an engaging lock in a side post such as the first side post. In this variation, once unlocked, the first front panel is rotated in the clockwise direction to gain access to a poster affixed to the non-transparent first rear panel. The poster is usually an advertisement or other poster which is usually paid for by a sponsor such as a company selling a product advertised on the poster or a message delivered by an organization such as a charity or a political party. It will be appreciated that any other poster is within the spirit and scope of the present invention. The poster is made of any acceptable material selected from the group consisting of paper, cardboard, posterboard, fiberboard and plastic. It is affixed to the non-transparent first rear panel by suitable affixing apparatus selected from the group consisting of double-sided tape and glued to the back of the poster and the front of the non-transparent rear surface, or stapled if the first rear panel can have staples affixed into it.

The second front panel is hingeably and rotatably connected to a portion of the second rear panel and retained in a locked condition with an engaging lock in a side post such as the second side post. In this variation, once unlocked, the second front panel is rotated in the counterclockwise direction to gain access to a poster affixed to the non-transparent second rear panel. The poster is usually an advertisement or other poster which is usually paid for by a sponsor such as a company selling a product advertised on the poster or a message delivered by an organization such as a charity or a political party. It will be appreciated that any other poster is within the spirit and scope of the present invention. The poster is made of any acceptable material selected from the group consisting of paper, cardboard, posterboard, fiberboard and plastic. It is affixed to the non-transparent second rear panel by suitable affixing apparatus selected from the group consisting of double-sided tape and glued to the back of the poster and the front of the non-transparent second rear panel, or stapled if the rear panel can have staples affixed into it.

It is also an object of the present invention to provide an apparatus to rotate an entire front and rear panel to a position where in does not block access to the traffic control signal box. Each panel is movably and slidably attached to a portion of the center post and a portion of a side post to be moved vertically upward and locked in a raised condition, A comparable structure is used for both full panels but the access door is located at one location of the traffic control signal box so depending on the location of the access door, only an apparatus to move one of the full panels is required.

It is additionally an object of the present invention to provide an information message at a top location of the sign.

Further novel features and other objects of the present invention will become apparent from the following detailed description and discussion.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1:
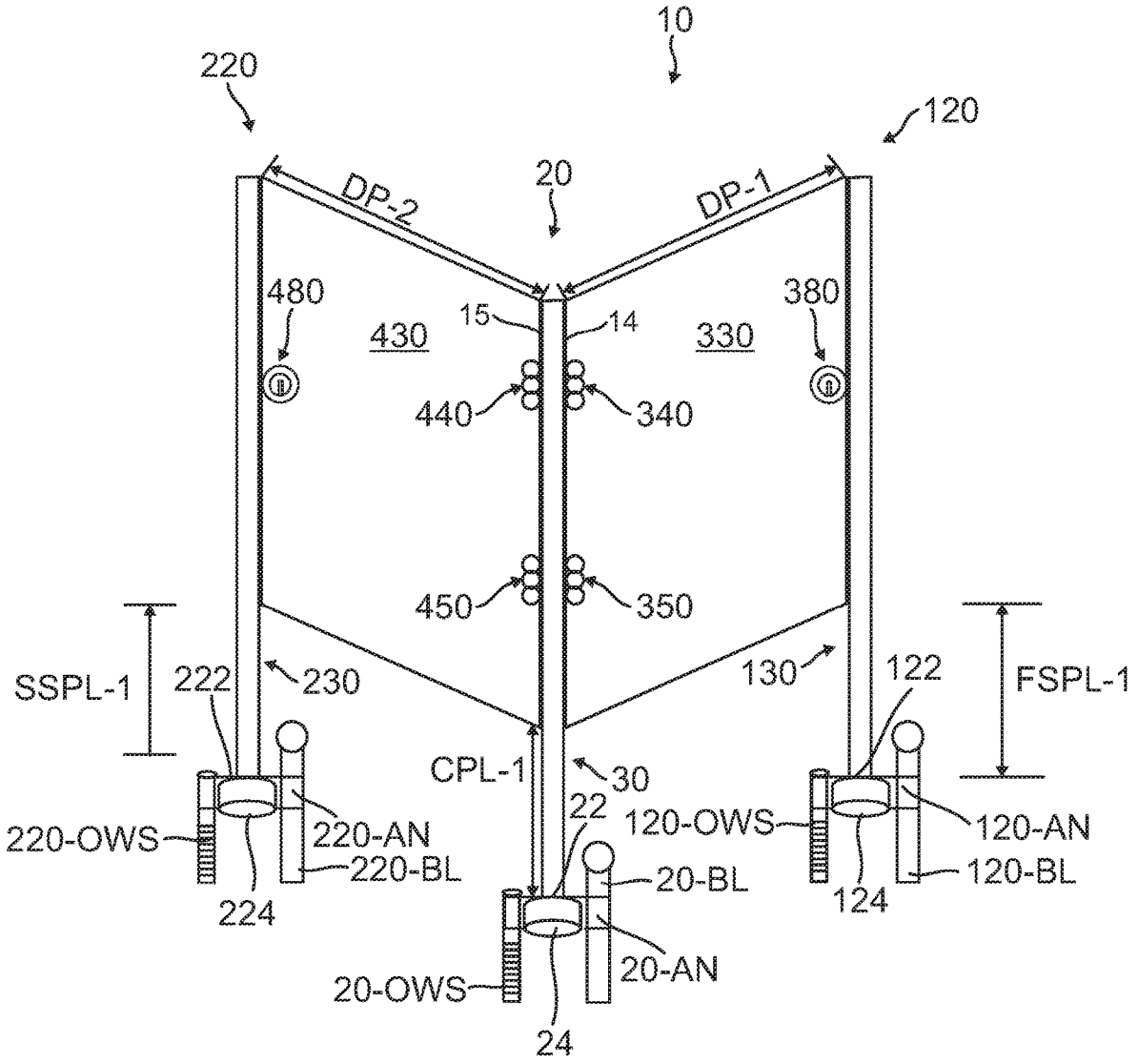
FIG. 1 is a front perspective view of the present invention multi-functional sidewalk sign including the center post, the first side post, the second side post, the first front panel, the second front panel, the leg, foot and retaining apparatus for each of the three posts.

Referring to FIG. 1, there is illustrated a front perspective view of the present invention multi-functional sidewalk sign including the center post, the first side post, the second side post, the first front panel, the second front panel, the leg, foot and retaining apparatus for each of the three posts.

Figure 2:
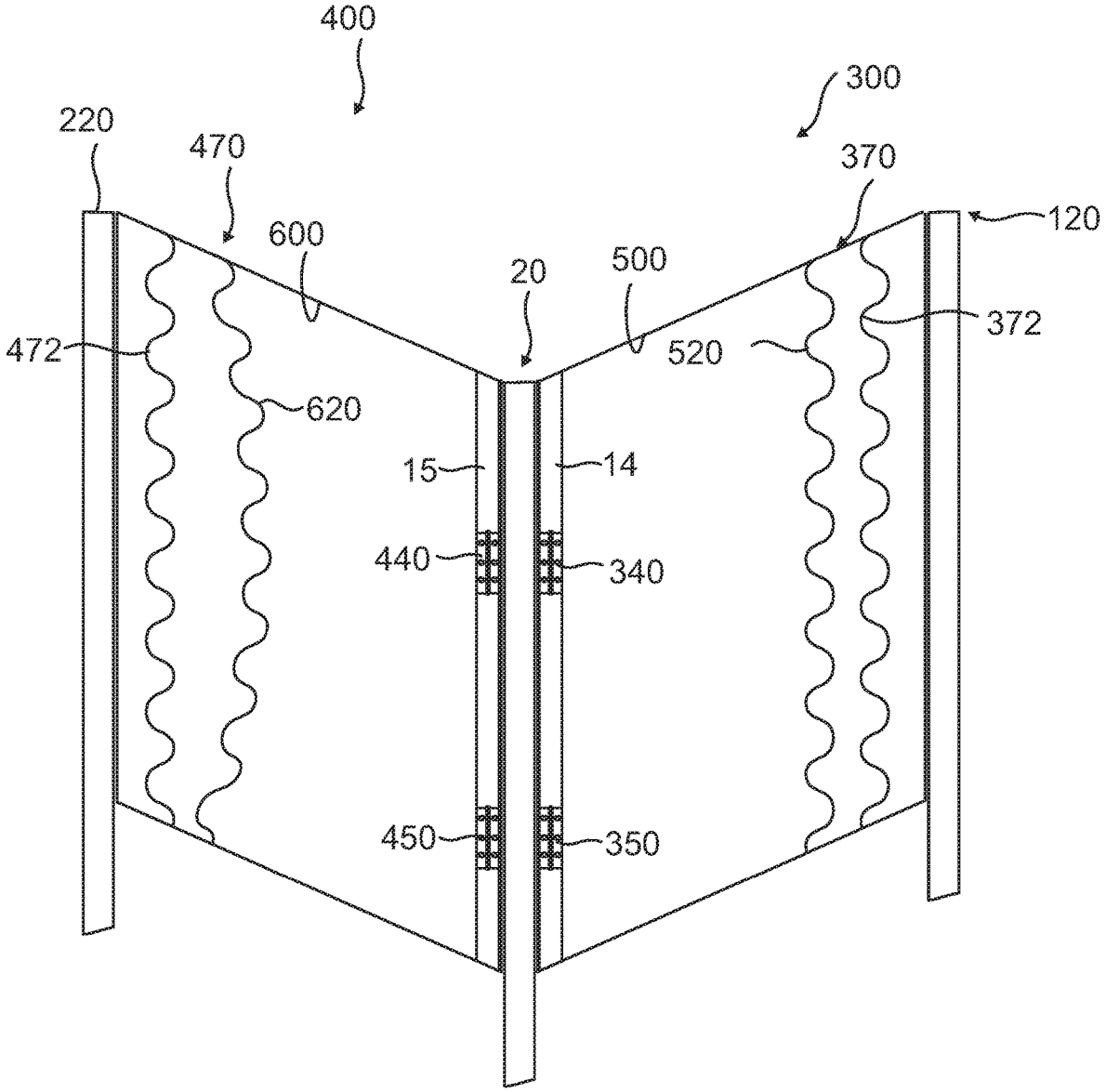
FIG. 2 is a front perspective view of the major portion of the present invention multi-functional sidewalk sign including the center post, the first side post, the second side post, the first full panel with the first front panel unlocked and partially rotated away from the first rear panel to expose the first poster retained on the first rear panel and the second full panel with the second front panel unlocked and partially rotated away from the second rear panel to expose the second poster.

Referring to FIG. 2, there is illustrated a front perspective view of the major portion of the present invention multi-functional sidewalk sign including the center post, the first side post, the second side post, the first full panel with the first front panel unlocked and partially rotated away from the first rear panel to expose the first poster retained on the first rear panel and the second full panel with the second front panel unlocked and partially rotated away from the second rear panel to expose the second poster.

Figure 3:
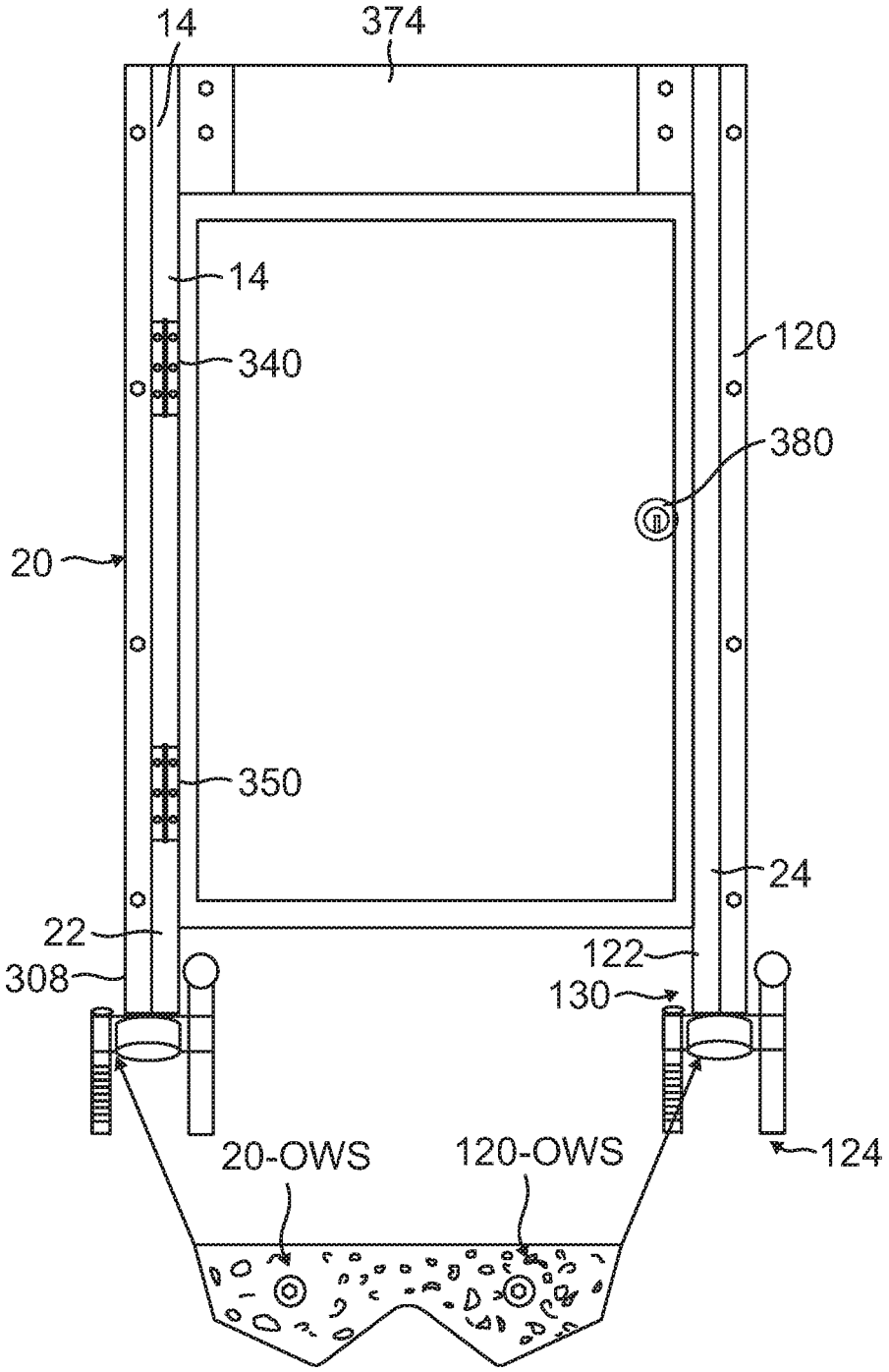
FIG. 3 is a front plan view of the first full panel hingeably attached to the first rear panel, the first front panel locked to the first side post, the information sign at the top of the multifunction sidewalk sign, and more detail of the leg, foot and retaining apparatus for the center leg assembly and the first side leg assembly.

Referring to FIG. 3, there is illustrated a front plan view of the first front panel hingeably attached to the first rear panel, the first front panel locked to the first side post, the information sign at the top of the multifunction sidewalk sign, and more detail of the leg, foot and retaining apparatus for the center leg assembly and the first side leg assembly.

Figure 4:
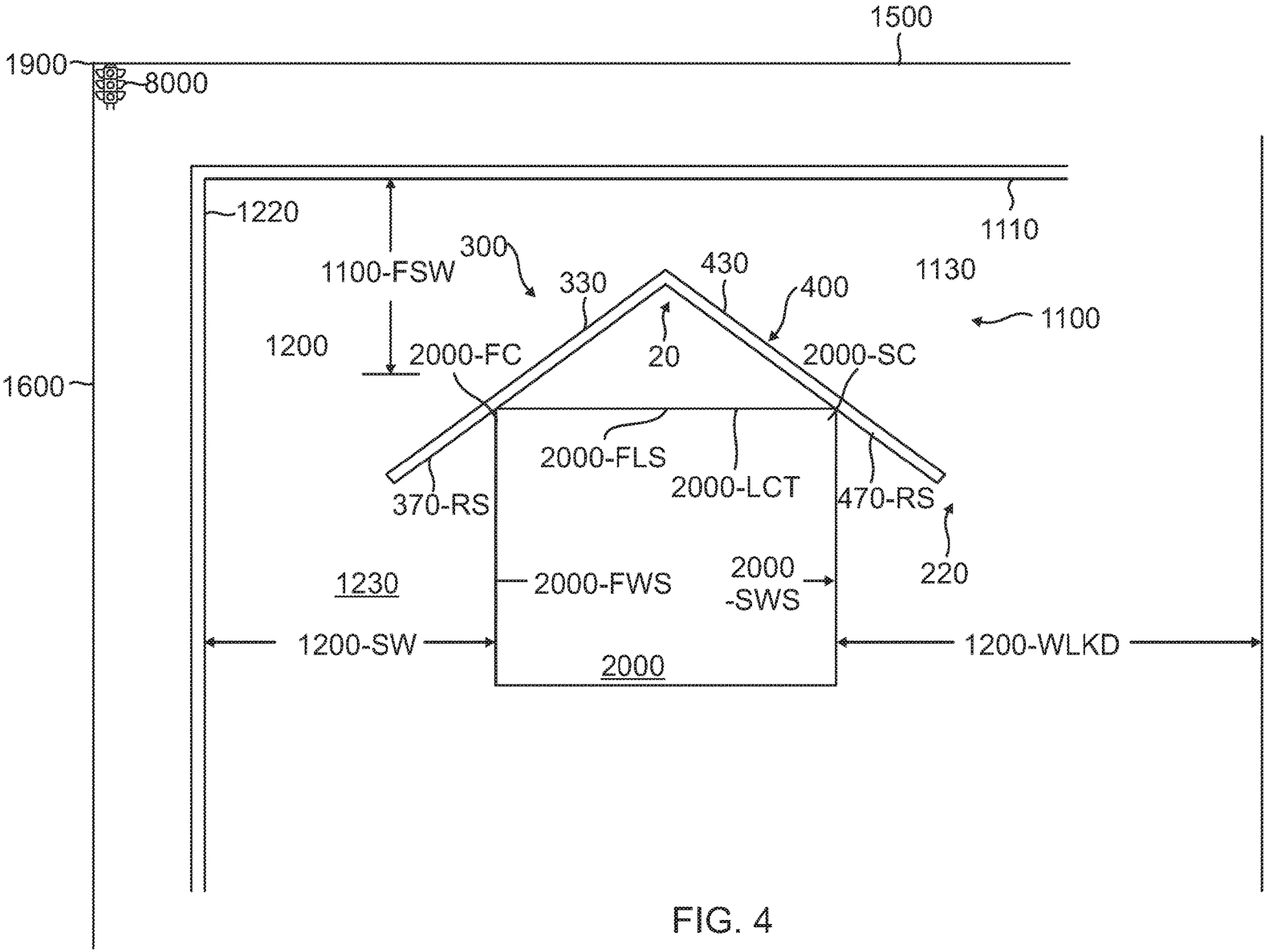
FIG. 4 is a top plan view of the position of the present invention multi-functional sidewalk sign positioned relative to a traffic control signal box, a first sidewalk, first curb, and first adjacent street and a second cross-sidewalk, second cross-curb and an adjacent second cross street at a traffic intersection, illustrating rotation of first side front panel and rotation of second side front panel.

Referring to FIG. 4, there is illustrated a top plan view of the position of the present invention multi-functional sidewalk sign positioned relative to a traffic control signal box, a first sidewalk, first curb, and first adjacent street and a second cross-sidewalk, second cross-curb and an adjacent second cross street at a traffic intersection, illustrating rotation of the first side front panel and rotation of the second side front pane.

Referring primarily to FIG. 1, there is illustrated a front perspective view of the present invention multi-functional sidewalk sign 10. The present invention multi-functional sidewalk sign 10 is affixed into a sidewalk 1100 or 1200 to prevent the sidewalk sign 10 from being moved or stolen. The present invention is a large display sign with two large rotatably connected panels, each of which retains a large poster which is visible from one to fifty feet away.

Referring to FIG. 4, there is illustrated a top plan view of the position of the present invention multi-functional sidewalk sign 10 positioned relative to a traffic control signal box 2000, a first sidewalk 1100, an adjacent curb 1110 and an adjacent street 1500 and a second cross-sidewall 1200, an adjacent curb 1210 and an adjacent second cross street 1600 at a traffic intersection 1900. The present invention is positioned and affixed into a sidewalk 1100 and 1200 adjacent a corner of intersecting traffic 1900 so that information on each retained poster is visible to oncoming traffic as a vehicle approaches the intersection traveling in a direction where the poster is visible to oncoming traffic on either street.

The present invention is also positioned so that it blocks access to the street visible portion of the traffic control signal box 2000 to protect it from vandals, gangs and others who tag the street visible surfaces of the traffic control signal box 2000 so that their message is seen by anyone who drives by.

The present invention includes several novel features including: (a) an ability to completely rotate one of the large panels away from blocking access to the traffic control signal box 2000 so that an authorized technician will have access to the traffic control signal box 2000 to provide standard maintenance and to repair a portion of the equipment if the traffic signal is not working or is working with signal problems (see FIG. 5 and the detailed description below); (b) an ability to rotate a panel to a location where the poster retained in the panel is removed and replaced with a different poster and to facilitate cleaning of the inside of the display portion (see FIG. 4 and the detailed description below).

Further referring to FIG. 1, the present invention 10 is a large multi-functional display structure which includes a center support post 20 and a first side support post 120 and a second side support post 220, each respective side support post being at a spaced apart distance "DP-1" and "DP-2" from the center support post 20 to provide supports for each full respective display panel.

Further referring to FIG. 1 and also illustrated in greater detail in FIG. 3 with detail in FIG. 4 on two of the legs 30 and 130, respective feet 24 and 124 and retaining apparatus for each, the center post 20 has a foot section to separate each full display panel from the top surface 1130 of concrete sidewalk 1100 and the top surface 1230 of concrete sidewalk 1200. Center post 20 includes a center post leg 30 having a height "CPL-1" between a bottom of a display panel and the concrete ground surface 1130 and 1230. The height "CPL-1" is in a range of at least one foot to three feet, and as illustrated in FIG. 1, is two feet (twenty-four inches). Center post leg 30 has a bottom end 22 with a foot 24 which is embedded into the concrete sidewalk 1100 and 1200 by a distance of three inches and secured therein by a center post anchor 20-AN and center post bolt 20-BL and covered with cement. Alternatively, the foot 24 is screwed into the concrete sidewalls 1100 and 1200 by a one-way screw 20-OWS.

Further referring to FIGS. 1, 2, 3 and 4, the first side post 120 has a foot section to separate each full display panel from the top surface 1110 of concrete sidewalk 1100. The first side post 120 includes a first side post leg 130 having a height "FSPL-1" between a bottom of a display panel and the concrete ground surface 1130. The height "FSPL-1" is in a range of at least one foot to three feet, and as illustrated in FIG. 1, is two feet (twenty-four inches). First side post leg 130 has a bottom end 122 with a foot 124 which is embedded into the concrete sidewalk 1100 by a distance of three inches and secured therein by a first side post anchor 120-AN and first side post bolt 120-BL and covered with cement. Alternatively, the foot 124 is screwed into the concrete sidewalk 1100 by a one-way screw 120-OWS.

Further referring to FIG. 1, the second side post 220 has a foot section to separate each full display panel from the top surface 1210 of concrete sidewalk 1200. Second side post 220 includes a second side post leg 230 having a height "SSPL-1" between a bottom of a display panel and the concrete ground surface 1210. The height "SSPL-1" is in a range of at least one foot to three feet, and as illustrated in FIG. 1, is two feet (twenty-four inches). Second side post 220 has a bottom end 222 with a foot 224 which is embedded into the concrete sidewalk 1200 by a distance of three inches and secured therein by a second post anchor 220-AN and second side post bolt 220-BL and covered with cement. Alternatively, the foot 224 is screwed into the concrete sidewalk 1200 by a one-way screw 220-OWS.

Referring to FIG. 2, there is illustrated a front perspective view of the three posts 20, 120 and 220 and the two full panels, 300 and 400, of the present invention multi-functional sidewalk sign 10. Also illustrated is a perspective view of the first front panel 330 rotated away from the first rear fixed metal panel 370 to change the first display poster 500. In addition, also illustrated is a perspective view of the second front panel 430 rotated away from the second rear fixed metal panel 470 to change the second display poster 600.

Referring to FIGS. 1, 2 and 3, the present invention 10 provides a display sign retaining a poster 500 in a first full panel 300 which includes a non-transparent back such as the metal rear frame panel 370 and the transparent front panel 330 with a display poster 500 affixed to the rear metal panel 370. The front panel 330 is preferably made of non-breakable transparent material, which by way of example, is fiberglass.

The first front panel 330 is hingeably and rotatably connected to a first portion 14 of the rear panel 370 at a location adjacent the central post 20 by a first hinge 340 and a spaced apart second hinge 350 and retained in a locked condition with an engaging lock 380 in the first side post 120. In this variation, once unlocked, the first front panel 330 is rotated in the clockwise direction to gain access to a poster 500 affixed to the front surface 372 of the non-transparent first rear panel 370. The poster 500 is usually an advertisement or other poster which is usually paid for by a sponsor such as a company selling a product advertised on the poster or a message delivered by an organization such as a charity or a political party. It will be appreciated that any other poster is within the spirit and scope of the present invention. The poster is made of any acceptable material selected from the group consisting of paper, cardboard, posterboard, fiberboard and plastic. It is affixed to the front surface 372 of the non-transparent first rear panel 370 by suitable affixing apparatus selected from the group consisting of double-sided tape and glued to the back 520 of the poster 500 and the front 372 of the non-transparent rear frame 370, or stapled if the first rear panel 370 can have staples affixed into it.

Referring to FIGS. 1, 2, and 3, the present invention 10 provides a display sign retaining a poster 500 in a first full panel 300 which includes a non-transparent back such as the metal rear frame panel 370 and the transparent front panel 330 with a display poster 500 affixed to the rear metal panel 370. The front panel 330 is preferably made of non-breakable transparent material, which by way of example, is fiberglass. An information sign 375 is attired adjacent to the top of the sign structure 10.

The first front panel 330 is hingeably and rotatably connected to a first portion 14 of the non-transparent first rear panel 370 by a first hinge 340 and a spaced apart second hinge 350 and retained in a locked condition with an engaging lock 380 in the first side post 120. In this variation, once unlocked, the first front panel 330 is rotated in the clockwise direction to gain access to a poster 500 affixed to the front surface 372 of the non-transparent first rear panel 370. The poster 500 is usually an advertisement or other poster which is usually paid for by a sponsor such as a company selling a product advertised on the poster or a message delivered by an organization such as a charity or a political party. It will be appreciated that any other poster is within the spirit and scope of the present invention. The poster is made of any acceptable material selected from the group consisting of paper, cardboard, posterboard, fiberboard and plastic. It is affixed to the front surface 372 of the non-transparent first rear panel 370 by suitable affixing apparatus selected from the group consisting of double-sided tape and glued to the back 520 of the poster 500 and the front 372 of the non-transparent rear frame 370, or stapled if the first rear panel 370 can have staples affixed into it.

Further referring to FIG. 2, the second front panel 430 is hingeably and rotatably connected to a second portion 15 of the non-transparent second rear panel 470 and retained in a locked condition with an engaging lock 480 in the second side post 220. In this variation, once unlocked, the second front panel 430 is rotated in the counterclockwise direction to gain access to a poster 600 affixed to the non-transparent second rear panel 470. The poster is usually an advertisement or other poster which is usually paid for by a sponsor such as a company selling a product advertised on the poster or a message delivered by an organization such as a charity or a political party.

The second front panel 430 is hingeably and rotatably connected to a second portion 15 of the second rear panel 470 at a location adjacent the central post 20 and retained in a locked condition with an engaging lock 480 in the second side post 220. In this variation, once unlocked, the second front panel 430 is rotated in the clockwise direction to gain access to a poster 600 affixed to the non-transparent second rear panel 470. The poster is usually an advertisement or other poster which is usually paid for by a sponsor such as a company selling a product advertised on the poster or a message delivered by an organization such as a charity or a political party. It will be appreciated that any other poster is within the spirit and scope of the present invention. The poster 600 is made of any acceptable material selected from the group consisting of paper, cardboard, posterboard, fiberboard and plastic. It is affixed to the front surface 472 of the non-transparent second rear panel 470 by suitable affixing apparatus selected from the group consisting of double sided tape and glue to the back 620 of the poster 600 and the front 472 of the non-transparent second rear panel 470, or stapled if the rear panel can have staples affixed into it.

Further referring to FIG. 4, there is illustrated a top plan view of the position of the present invention multi-functional sidewalk sign 10 positioned relative to a traffic control signal box 2000, a first sidewalk 1100, a first curb 1110, and an adjacent first street 1500 and a second cross-sidewalk 1200, a second curb 1210, and an adjacent cross street 1600 at a traffic intersection 1900. The traffic control signal box 2000 has a first widthwise side 2000-FWS which is equal to twenty-four inches and a parallel second widthwise side 2000-SWS equal to twenty-four inches. A first lengthwise side 2000-FLS is equal to thirty-three inches. The traffic control box is frequently forty-eight inches tall. A first corner 2000-FC of the traffic control signal box 2000 is at the intersection of first widthwise side 2000-FWS and first lengthwise side 2000-FLS. A second corner 2000-SC of the traffic control signal box 2000 is at the intersection of second widthwise side 2000-SWS and first lengthwise side 2000-FLS.

As illustrated in FIG. 4, the traffic control signal box 2000 is positioned with the first lengthwise side 2000-FLS parallel to first street 1500 and both the first widthwise side 2000-FWS and the second widthwise side 2000-SWS is parallel to the second intersecting cross-street 1600 at the intersection 1900. By way of example, the width of the street 1100-FSW from the first lengthwise side 2000-FLS of the traffic control signal box 2000 to the first curb 1110 is forty-two (42) inches and the first curb 1130 is seven (7) inches wide for a total distance of forty-nine (49) inches to where first street 1500 begins.

In the cross-direction, the width of the street 1200-SW from the second widthwise side 2000-SWS of the traffic control signal box 2000 is twenty-eight (28) inches from the second curb 1230 which is seven (7) inches wide for a total of at least thirty-five inches. In addition, widthwise walking 1200-WLKD distance between an opposite first widthwise side 2000-FWS of the traffic control signal box 2000 and a storefront is at least sixty-two inches for pedestrian foot traffic.

An important feature of the present invention is the ability to affix the sign 10 into the concrete to protect the traffic control signal box 200 but not interfere with foot traffic on the street.

Further referring to FIG. 4, it is an additional object of the present invention to position the center post 20 at a location at an approximate lengthwise center 2000-LCT of first lengthwise side 2000-FLS of a traffic control signal box 2000 and at a distance from the traffic control signal box so that a rear surface 370-RS of a first real panel 370 is adjacent a first corner 2000-FC at an intersection of a lengthwise side 2000-FLS and a first widthwise side 2000-FWS of the traffic control signal box 2000 and a rear surface 470-RS of a second panel is adjacent a second corner 2000-SC at an intersection of the same lengthwise side 2000-FLS and an opposite second widthwise side 2000-SWS of the traffic control signal box 2000.

Figure 5:
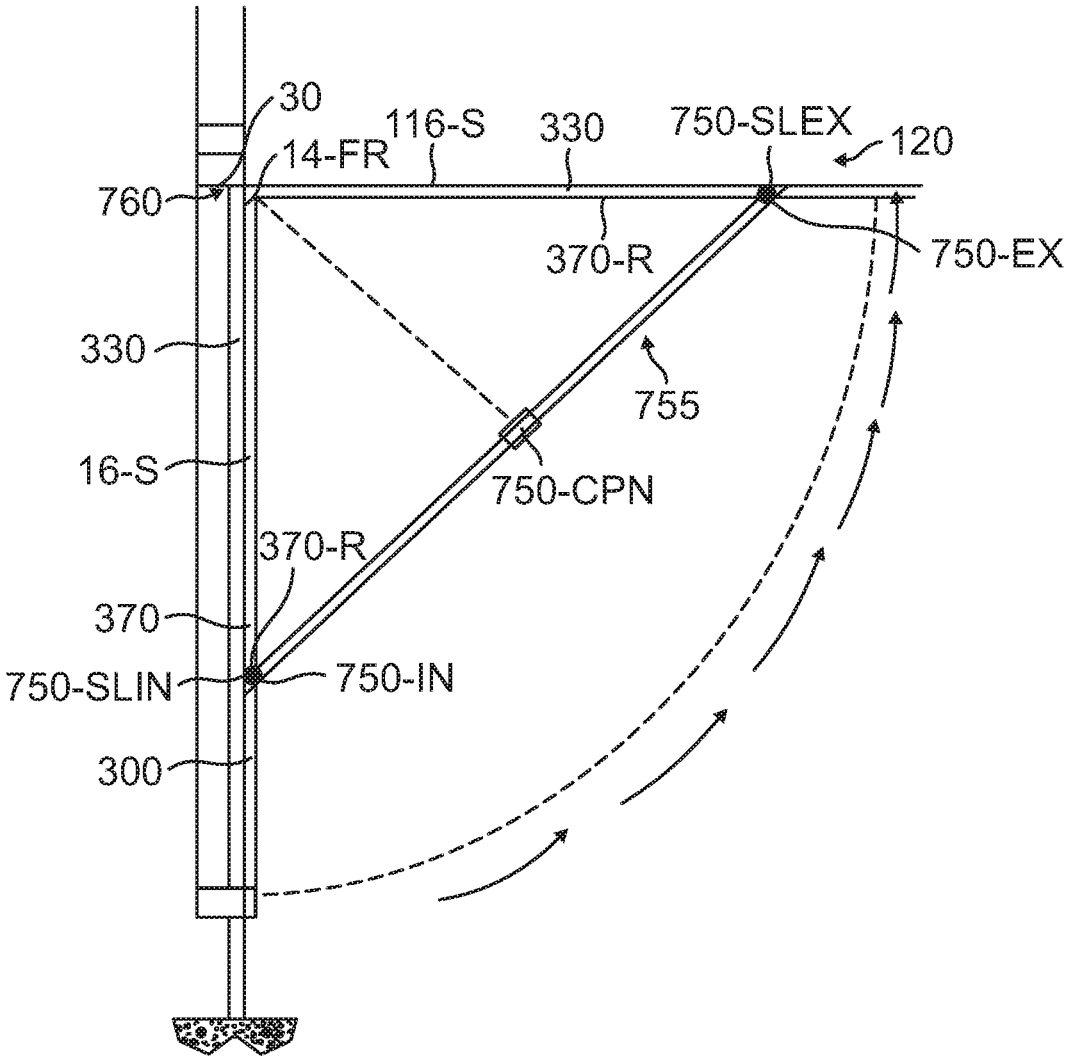
FIG. 5 is a side elevational view of an entire panel rotated vertically to enable access to the traffic control signal box.

Referring to FIG. 5, there is illustrated a side elevational view of an entire front panel 300 rotated vertically to enable access to the traffic control signal box 2000. It is also an object of the present invention to provide an apparatus to rotate an entire front 330 and rear 370 panel to a position where it does not block access to the traffic control signal box 2000. The panel 300 is movably and slidably attached to a portion of the rear panel 370-R to be moved vertically upward from 16-S to 116-S and locked in a raised condition. A retention bar 755 has an interior end 750-IN attached to the back 370-R of rear frame 370 by interior slide attachment 750-SLIN and the retention bar 755 has an exterior end 750-EX attached to the back 370-R of rear panel 770-R by exterior slide attachment 750-SLEX. The retention bar 750 has a center pin 750-CPN so that the retention bar 750 folded inward as the full panel 300 is raised and locked in an elevated condition by locking attachment 760 locked onto a transverse cross frame 14-FR between center post 20 and first exterior post 120. A comparable structure is used for both full panels but the access door is located at one location of the traffic signal control box so depending on the location of the access door, only an apparatus to move one of the full panels is required.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A multi-functional sidewalk display sign positioned to block access to street facing portions of a traffic control signal box having at least one lengthwise side parallel to a first street and at least one widthwise side parallel to a second intersecting cross street, the traffic control signal box located on a street within physical viewing distance of an intersection of the first street and the second intersecting cross street, the multi-functional display sign comprising:

(a) a center support post, a spaced apart first side support post to one side of the center support post and an opposite spaced apart second support post at an opposite side of the center support post, the center support post including a center post leg terminating in a center post foot retained within at least one of said first street or said second cross street, the first side support post including a first side support post leg terminating in a first side support post foot retained within at least one of said first street or said second cross street, and the second side support post including a second side support post leg terminating in a second side support post foot retained within at least one of said first street or said second cross street;

(b) a first full panel including a first non-transparent back panel having a front surface and a rear surface, the first full panel further including a first transparent front panel having a front surface and a rear surface, a first display poster affixed to the front surface of the first non-transparent back panel, the first front panel hingeably and rotatably connected to the first non-transparent back panel at a location adjacent the central post, the connection through a first hinge and a spaced apart second hinge, the first front panel retained in a locked condition with an engaging lock in the first side post, and in an unlocked condition, the first front panel is rotatable in the clockwise direction relative to the first back panel to facilitate access to the first poster, and in the locked condition, the poster is visible through the transparent front panel;

(c) a second full panel including a second non-transparent back panel having a front surface and a rear surface, the second full panel further including a second transparent front panel having a front surface and a rear surface, a second display poster affixed to the front surface of the second non-transparent back panel, the first front panel hingeably and rotatably connected to the second non-transparent back panel at a location adjacent the central post, the connection through a first hinge and a spaced apart second hinge, the second front panel retained in a locked condition with an engaging lock in the second side post, and in an unlocked condition, the second front panel is rotatable in the counterclockwise direction relative to the second back panel to facilitate access to the second poster, and in the locked condition, the second poster is visible through the second transparent front panel;

(d) both the first front panel and the first rear panel of the first full panel are movably and slidably attached to a portion of the center post and a portion of the first side post through a retention bar having an interior end attached to a back of the rear panel by interior slide attachment apparatus and the retention bar having an exterior end attached to a back of the rear panel by an exterior slide attachment apparatus, the retention bar having a center pin so that the retention bar is folded inward as the full first panel is raised and locked in an elevated condition by a locking attachment locked onto a transverse cross frame between the center post and the first exterior post;

(e) the central post is affixed into a location on a street aligned with a center of the lengthwise side of the traffic control signal box between the traffic control signal box and the first street and at a distance from the traffic control signal box so that the rear surface of a first rear panel is adjacent a first corner at an intersection of a lengthwise side and a first widthwise side of the traffic control signal box and the rear surface of a second panel is adjacent a second corner at an intersection of the same lengthwise side and an opposite second widthwise side of the traffic control signal box, to block access to a portion of the first lengthwise side and first widthwise side of the traffic control signal box visible from either the first street or the second cross street in the area of said intersection.

2. The multi-functional sidewalk display sign in accordance with claim 1, further comprising:

(a) said center post leg having a height between a bottom of said first and second full display panels and a concrete ground surface between one foot and three feet, said center post leg t leg bottom end with said foot embedded into at least one concrete sidewalk by a distance of at least three inches and secured therein by a foot retaining apparatus selected from the group consisting of a center post anchor retained by a center post bolt and a center post one-way screw;

(b) said first side post leg having a height between a bottom of said first and second full display panels and a concrete ground surface between one foot and three feet, said first side post leg bottom end with said foot embedded into at least one concrete sidewalk by a distance of at least three inches and secured therein by a foot retaining apparatus selected from the group consisting of a first side post anchor retained by a first side post bolt and a first side post one-way screw; and (c) said second side post leg having a height between a bottom of said first and second full display panels and a concrete ground surface between one foot and three feet, said second side post leg bottom end with said foot embedded into at least one concrete sidewalk by a distance of at least three inches and secured therein by a foot retaining apparatus selected from the group consisting of a second side post anchor retained by a second side post bolt and a second side post one-way screw.

3. The multi-functional sidewalk display sign in accordance with claim 1, further comprising:

(a) said first non-transparent back panel is made of metal and said first transparent front panel is made of fiberglass; and (b) said second non-transparent back panel is made of metal and said second transparent front panel is made of fiberglass.

4. A multi-functional sidewalk display sign positioned to block access to street facing portions of a traffic control signal box having at least one lengthwise side parallel to a first street and at least one widthwise side parallel to a second intersecting cross street, the multi-functional display sign comprising:

(a) a center support post, a spaced apart first side support post to one side of the center support post and an opposite spaced apart second support post at an opposite side of the center support post, the center support post including a center post leg terminating in a center post foot retained within at least one of said first street or said second cross street, the first side support post including a first side support post leg terminating in a first side support post foot retained within at least one of said first street or said second cross street, and the second side support post including a second side support post leg terminating in a second side support post foot retained within at least one of said first street or said second cross street;

(b) a first full panel including a first non-transparent back panel having a front surface and a rear surface, the first full panel further including a first transparent front panel having a front surface and a rear surface, the front surface of the first non-transparent back panel including a surface to retain at least one display, the first front panel hingeably and rotatably connected to the first non-transparent back panel at a location adjacent the central post, the first front panel including a closing apparatus, the first front panel rotatable in the clockwise direction relative to the first non-transparent back panel to facilitate access to the front surface of the first non-transparent back panel;

(c) a second full panel including a second non-transparent back panel having a front surface and a rear surface, the second full panel further including a second transparent front panel having a front surface and a rear surface, the front surface of the second non-transparent back panel including a surface to retain at least one display, the second front panel hingeably and rotatably connected to the second non-transparent back panel at a location adjacent the central post, the second front panel including a closing apparatus, the second front panel rotatable in the counterclockwise direction relative to the second non-transparent back panel to facilitate access to the front surface of the second non-transparent back panel; and (d) the central post affixed into a location on a street aligned with a center of the lengthwise side of the traffic control signal box between the traffic control signal box and the first street and at a distance from the traffic control signal box so that the rear surface ofa first rear panel is adjacent a first corner at an intersection of a lengthwise side and a first widthwise side of the traffic control signal box and the rear surface of a second panel is adjacent a second corner at an intersection of the same lengthwise side and an opposite second widthwise side of the traffic control signal box, to block access to a portion of the first lengthwise side and first widthwise side of the traffic control signal box visible from either the first street or the second cross street in the area of said intersection.

5. The multi-functional sidewalk display sign in accordance with claim 4, further comprising: both the first front panel and the first rear panel of the first full panel are movably and slidably attached to a portion of the center post and a portion of the first side post through a retention bar having an interior end attached to a back of the rear panel by interior slide attachment apparatus and the retention bar having an exterior end attached to a back of the rear panel by exterior slide attachment apparatus, the retention bar having a center pin so that the retention bar is folded inward as the full first panel is raised and locked in an elevated condition by a locking attachment locked onto a transverse cross frame between center post and the first exterior post.

6. The multi-functional sidewalk display sign in accordance with claim 4, further comprising:

(a) said center post leg having a height between a bottom of said first and second full display panels and a concrete ground surface between one foot and three feet, said center post leg bottom end with said foot embedded into at least one concrete sidewalk by a distance of at least three inches and secured therein by a foot retaining apparatus selected from the group consisting of a center post anchor retained by a center post bolt and a center post one-way screw;

(b) said first side post leg having a height between a bottom of said first and second full display panels and a concrete ground surface between one foot and three feet, said first side post leg bottom end with said foot embedded into at least one concrete sidewalk by a distance of at least three inches and secured therein by a foot retaining apparatus selected from the group consisting of a first side post anchor retained by a first side post bolt and a first side post one-way screw; and (c) said second side post leg having a height between a bottom of said first and second full display panels and a concrete ground surface between one foot and three feet, said second side post leg bottom end with said foot embedded into at least one concrete sidewalk by a distance of at least three inches and secured therein by a foot retaining apparatus selected from the group consisting of a second side post anchor retained by a second side post bolt and a second side post one-way screw.

7. The multi-functional sidewalk display sign in accordance with claim 4, further comprising:

(a) said first non-transparent back panel is made of metal and said first transparent front panel is made of fiberglass; and ((b) said second non-transparent back panel is made of metal and said second transparent front panel is made of fiberglass.

* * * * *